US005676536A

United States Patent [19]

Rühl et al.

[11] Patent Number: 5,676,536

[45] Date of Patent: Oct. 14, 1997

[54] RAW GAS BURNER AND PROCESS FOR BURNING OXYGENIC CONSTITUENTS IN PROCESS GAS

[75] Inventors: Andreas Rühl, De Pere; Patrick McGehee; Kim Anderson, both of Green Bay, all of Wis.; Serguei Charamko, Potts Point, Australia

[73] Assignee: W.R. Grace & Co.-Conn., New York, N.Y.

[21] Appl. No.: 532,209

[22] Filed: Nov. 13, 1995

Related U.S. Application Data

[62] Division of Ser. No. 356,601, Dec. 15, 1994, Pat. No. 5,601,789.

[51] Int. Cl.[6] ..... F23D 14/00

[52] U.S. Cl. ..... 431/5; 431/12; 431/19; 431/75; 422/168; 422/203; 422/204

[58] Field of Search ..... 431/5, 12, 19, 431/11, 189, 242, 76, 74, 75, 2, 81, 8, 247; 423/210; 422/111, 168, 173, 203, 183, 204

[56] References Cited

U.S. PATENT DOCUMENTS

| | | | |
|---|---|---|---|
| 3,549,333 | 12/1970 | Tabak | 23/277 C |
| 3,806,322 | 4/1974 | Tabak | 23/277 C |
| 3,838,975 | 10/1974 | Tabak | 23/277 C |
| 3,898,040 | 8/1975 | Tabak | 23/277 C |
| 4,334,854 | 6/1982 | Graat | 431/189 |
| 4,364,724 | 12/1982 | Alpkvist | 431/11 |
| 4,365,951 | 12/1982 | Alpkvist | 431/82 |
| 4,444,735 | 4/1984 | Birmingham | 431/5 |
| 4,850,857 | 7/1989 | Obermuller | 431/242 |
| 5,333,395 | 8/1994 | Bulcsu | 34/79 |

FOREIGN PATENT DOCUMENTS

| | | |
|---|---|---|
| 2037864 | 9/1991 | Canada . |
| 2352204 | 4/1975 | Germany . |
| 3043286A1 | 10/1981 | Germany . |
| 3332070A1 | 3/1985 | Germany . |

*Primary Examiner*—James C. Yeung

*Attorney, Agent, or Firm*—Craig K. Leon; William L. Baker; Kevin S. Lemack

[57] ABSTRACT

Raw gas burner that maximizes fuel efficiency of the burner, minimizes residence time, and reduces or eliminates flame contact with the process air or gas in order to minimize NOx formation. Process air flow such as from the cold side of a heat exchanger associated with thermal oxidizer apparatus is directed into and around the burner. The amount of process air flowing into the burner is regulated based upon the pressure drop created by the burner assembly. The pressure drop is, in turn, regulated by one or more of an external damper assembly, an internal damper assembly, and movement of the burner relative to the apparatus in which it is mounted. To ensure thorough mixing of the fuel and process air, process air entering the burner is caused to spin by the use of a swirl generator. The fuel/process air mixture proceeds into the combustion section of the burner, where the swirling flow is caused to recirculate to ensure complete combustion of the fuel in the combustion chamber. The mixture of burned fuel and process gas transfers its energy flamelessly to the process gas circulating outside the burner combustion chamber, and is hot enough to ignite the process gas there, which then burns separately from the burner combustion chamber, such as in the main combustion enclosure of the thermal post-combustion device.

4 Claims, 7 Drawing Sheets

RAW GAS BURNER AND PROCESS FOR BURNING OXYGENIC CONSTITUENTS IN PROCESS GAS

This application is a divisional of application Ser. No. 08/356,601 filed Dec. 15, 1995, U.S. Pat. No. 5,601,789.

BACKGROUND OF THE INVENTION

This invention relates to a burner for the combustion of oxidizable substances in a carrier gas, and a process for burning combustibles. In a preferred embodiment, the present invention relates to a burner for a thermal post-combustion device, typically used in the printing industry, to burn effluent containing environmentally hazardous constituents, and a process for burning combustibles with such a burner.

Recently, environmental considerations have dictated that effluent released to atmosphere contain very low levels of hazardous substances; national and international NOx emission regulations are becoming more stringent.

NOx emissions are typically formed in the following manner. Fuel-related NOx are formed by the release of chemically bound nitrogen in fuels during the process of combustion. Thermal NOx is formed by maintaining a process stream containing molecular oxygen and nitrogen at elevated temperatures in or after the flame. The longer the period of contact or the higher the temperature, the greater the NOx formation. Most NOx formed by a process is thermal NOx. Prompt NOx is formed by atmospheric oxygen and nitrogen in the main combustion zone where the process is rich in free radicals. This emission can be as high as 30% of total, depending upon the concentration of radicals present.

In order to ensure the viability of thermal oxidation as a volatile organic compound (VOC) control technique, lower NOx emissions burners must be developed.

It is therefore an object of the present invention to provide a raw gas burner which minimizes NOx formation by controlling the conditions that are conducive to NOx formation.

SUMMARY OF THE INVENTION

The problems of the prior art have been overcome by the present invention, which provides a raw gas burner design that maximizes fuel efficiency of the burner, minimizes residence time, and reduces or eliminates flame contact with the process air or gas in order to minimize NOx formation. The burner of the present invention meets or exceeds worldwide NOx and CO emission standards for thermal emission control devices.

Process air flow such as from the cold side of a heat exchanger associated with thermal oxidizer apparatus or the like, such as that disclosed in U.S. Pat. No. 4,850,857 (the disclosure of which is herein incorporated by reference), is directed into and around the burner. The portion of the process air directed into the burner provides the necessary oxygen for combustion of fuel. The portion of the process air not entering the burner provides cooling to the external burner surfaces. The amount of process air flowing into the burner is regulated based upon the pressure drop created by the burner assembly. The pressure drop is, in turn, regulated by one or more of an external damper assembly, an internal damper assembly, and movement of the burner relative to the apparatus in which it is mounted.

Process air entering the burner is caused to spin by the use of a swirl generator. This ensures thorough mixing of the fuel and this process air, and also results in a stable flame within the combustion chamber. The fuel supplied to the burner at a constant velocity enters the swirling process air at the base of the burner assembly and in the center of the swirling process air. Preferably gas fuel, which generally contains no chemically bound nitrogen, is used. The fuel mixes with the process air and the fuel/process air mixture proceeds into the combustion section of the burner, where the swirling flow is caused to recirculate. This recirculation ensures complete combustion of the fuel in the combustion chamber. The mixture of burned fuel and process gas transfers its energy flamelessly to the process gas circulating outside the burner combustion chamber, and is hot enough to ignite the process gas there, which then burns separately from the burner combustion chamber, such as in the main combustion enclosure of the thermal post-combustion device. The temperature stratification in the flame tube is decreased significantly, providing for better and earlier oxidation of the process VOC's. In contrast to the prior art, the fuel burns exclusively in the burner combustion chamber, which guarantees a substantial reduction in NOx.

The portion of the process gas flowing through the burner is controllable and adjustable, depending upon the burner power, for example. In a preferred embodiment, the portion of the process gas entering the swirl mixing chamber of the burner is controlled by moving the combustion chamber axially along a longitudinal axis. This procedure adjusts the pressure drop of the burner, which in turn controls the amount of process gas entering the swirl mixing chamber.

Preferably at least some of the process gas being fed into the swirl mixing chamber enters tangentially, at least at first, and the is redirected axially in the direction of the swirl mixing chamber. This combination of axial and tangential motion results in especially reliable combustion during fluctuating supply flows.

BRIEF DESCRIPTION OF TEE DRAWINGS

DETAILED DESCRIPTION OF THE INVENTION

Figure 6:
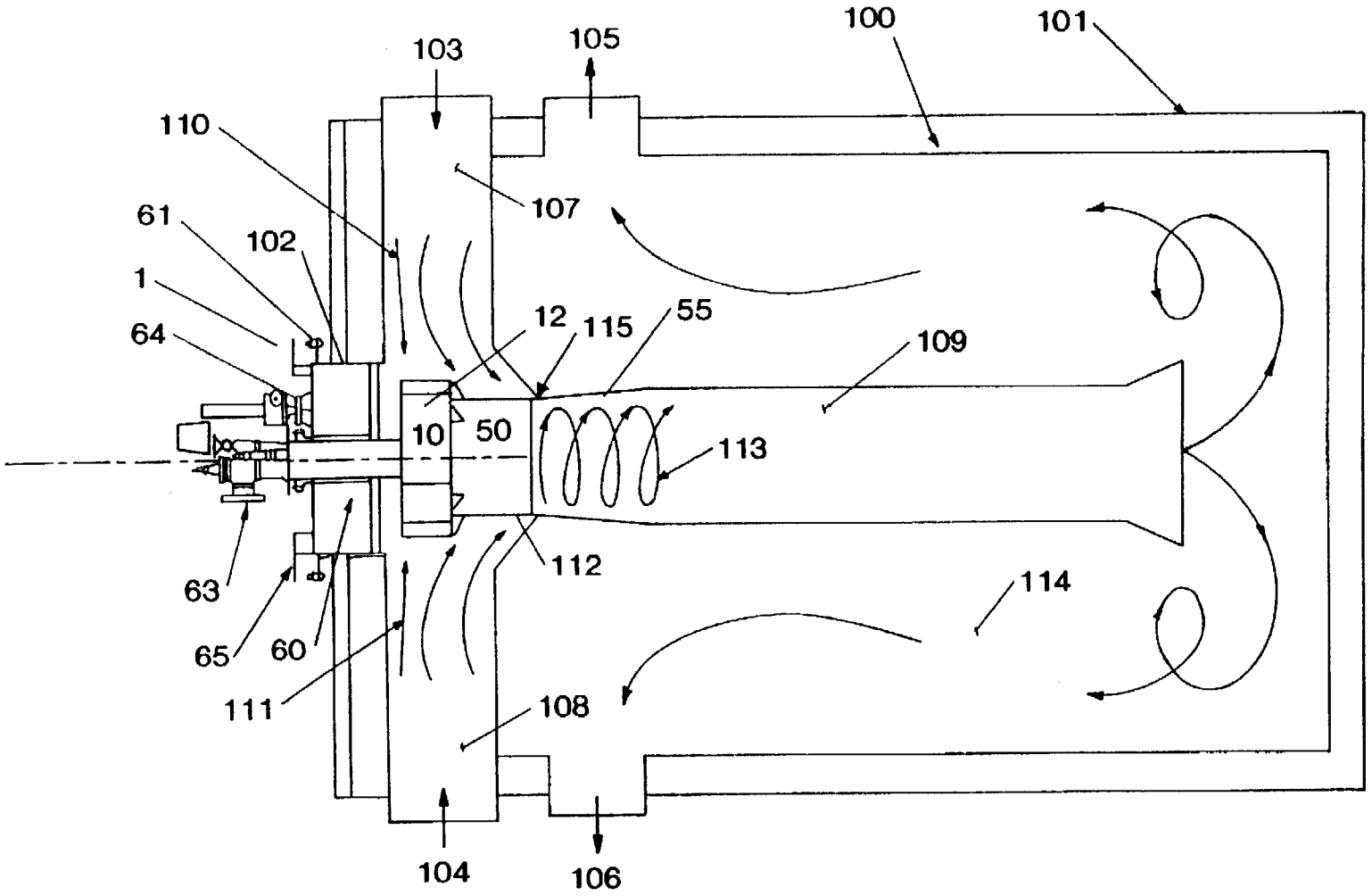
FIG. 6 is a schematic view of the burner installed in an oxidizer in accordance with the present invention.

Turning first to FIG. 6, there is shown a schematic view of a burner 1 mounted as part of a device 100 for the post-combustion of a process gas. The device 100 features an outer side 101 in which an opening 102 has been made to receive the burner 1, as well as feed openings 103, 104 for process gas and exhaust openings 105, 106 for combustion substances. Running parallel to the external face 101, feed ducts 107, 108 conduct the process gas entering through feed openings 103, 104, respectively, which then passes through or along the combustion chamber 50 into a flame tube 109 integrated in the device 100. The process gas flows from one outlet of the cold side of a heat exchanger (not shown) into the feed ducts 107, 108. A portion of the process gas, identified by arrows 110, 111, flows through openings 12 in the swirl mixing chamber 10, and supplies the burner 1 with the required oxygen for combustion of the fuel. The remainder of the process gas not fed into the burner flows along the outer surface of the combustion chamber 50. This causes a heat exchange to take place between the combustion chamber 50 and the process gas overflow, which results in a cooling of the combustion chamber 50. The exterior of the combustion chamber 50 may include a plurality of cooling ribs to enhance this heat exchange.

Swirling combustion products flow out of the burner opening 55 without flame contact and mix with the process gas entering through the opening 112 into the flame tube 109. A mixture 113 of combustion products and process gas flows in a swirl along the flame tube 109, which reduces the temperature gradient within the flame tube and permits better and more rapid oxidation of the volatile organic substances contained in the process gas.

After the combustion products leave the flame tube 109, they enter a main combustion enclosure 114 of the device 100 in which post-combustion takes place. The exhaust gases can leave the device 100 through the outlets 105, 106 built into the main combustion enclosure 114.

The burner 1 includes a swirl mixing chamber 10, a combustion chamber 50 immediately following and in communication with the swirl mixing chamber 10, and a holding assembly 60 onto which the swirl mixing chamber 10 is fastened by bolts 61 or by other suitable means. The holding assembly 60 also contains the fuel lance 63, UV flame scanner 66 and ignition device 67. Burner movement in the longitudinal axis is controlled by the positioning motor 64.

Within the burner 1, specifically along its longitudinal axis, the lance 63 is extended through which fuel such as natural gas is fed into the swirl mixing chamber 10. The openings 12 through which a portion of the process gas flows into the swirl mixing chamber 10 are positioned peripherally in the swirl mixing chamber 10.

Figure 1A:
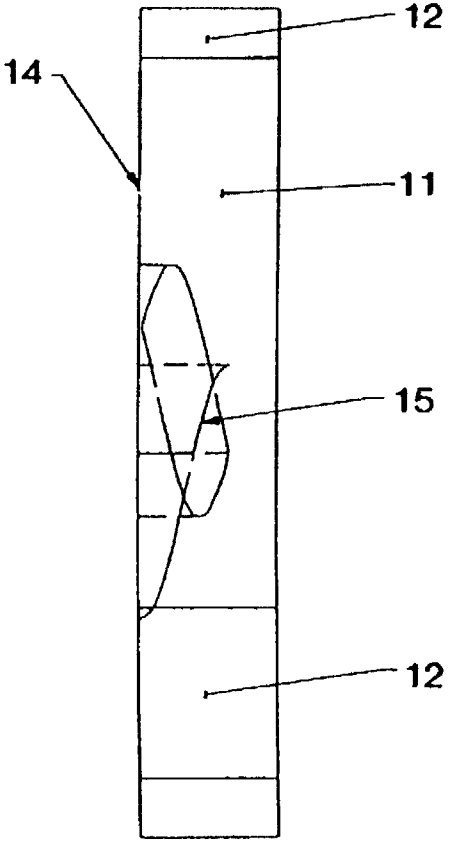
FIG. 1A is a prospective view of the swirl mixing chamber of FIG. 1.
Figure 1:
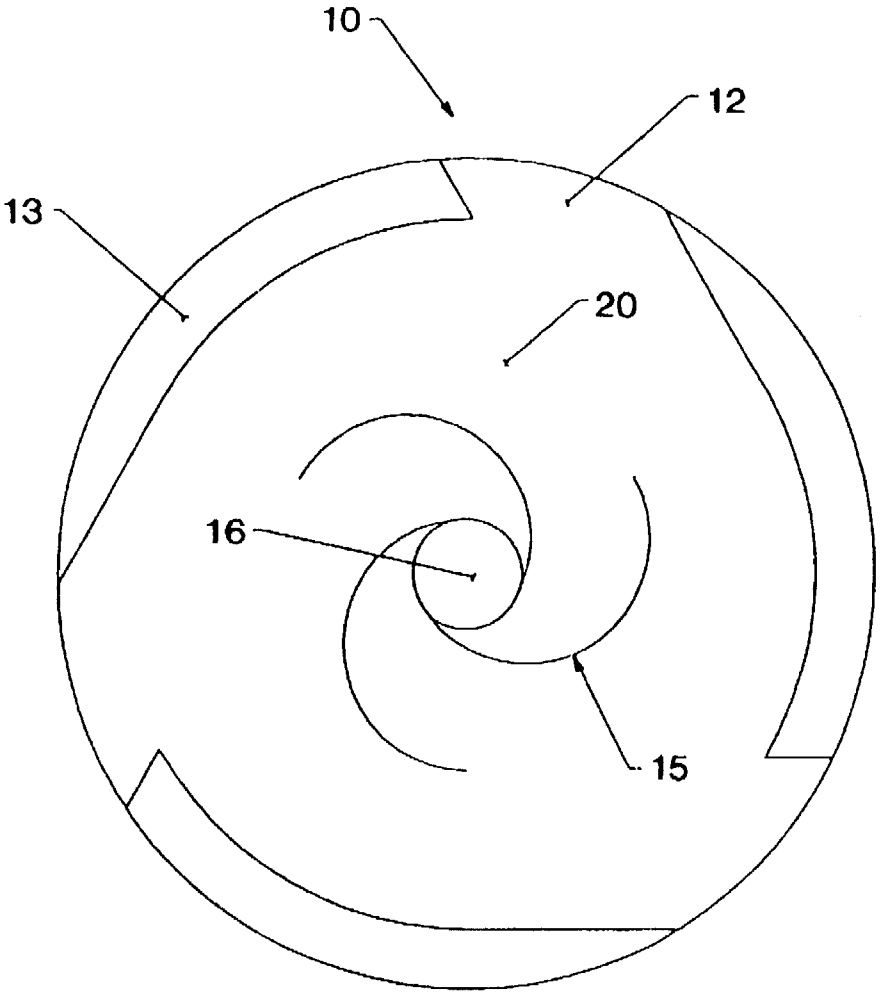
FIG. 1 is a front view of the swirl mixing chamber of the burner in accordance with the present invention.

The mixing of the process gas and the fuel is critical to the performance of the raw gas burner of the invention. To insure that the fuel is burned in the burner combustion chamber efficiently, so as to achieve the desired low NOx and CO emissions, the swirl mixing chamber 10 illustrated in FIGS. 1 and 1A is used, which employs radial and tangential swirl techniques to achieve a stable mixing zone over a large process flow range. The swirling motion of the mixture also results in a stable flame within the combustion chamber 50. The swirl mixing chamber 10 includes three main components. An inlet cylinder 11 (FIG. 1A) defines the outer boundary of the burner. Several openings 12 in the cylinder 11 allow the process air to enter the burner. The size and quantity of the openings 12 control the swirl of the process air. The openings 12 are preferably of a rectangular or square shape with a total open area so as to result in a process air inlet velocity of 20 to 80 meters per second. The number of openings 12 is variable, with from 2 to 10 being typical. Three are shown, spaced at about 120° intervals. On the inside of the cylinder 11 and located at each opening 12 is a flow guide 13. Each guide 13 is shaped like a curved ramp or wedge, and is mounted flush to the base and has the same height as the opening 12. Each guide 13 directs the incoming flow to begin the swirl of the process air.

The base of the swirl mixing chamber 10 is defined by a flat base plate 14 which closes one end of the cylinder 11. The base plate 14 serves to mount and locate the internal swirl generator 20, the fuel nozzle, and to mount the burner 1 to the insulation plug. The base plate includes an opening 16 at its center for receiving the lance 63.

The internal swirl generator 20 includes several curved plates or vanes 15 with one border flush against and mounted to the base plate 14 of the burner. The overall diameter of the swirl generator 20 is preferably about ⅓ to about ¼ the diameter of the inlet cylinder 11. The number of vanes 15 preferably matches the number of openings 12 in the inlet cylinder 11, although more or less could be used without departing from the spirit and scope of the present invention. The number, shape and incline of the internal vanes 15 determines the intensity of the central swirl. Suitable examples are illustrated in FIGS. 2A, 2B, 2C and 2D.

Figures 2A, 2B, 2C, 2D:
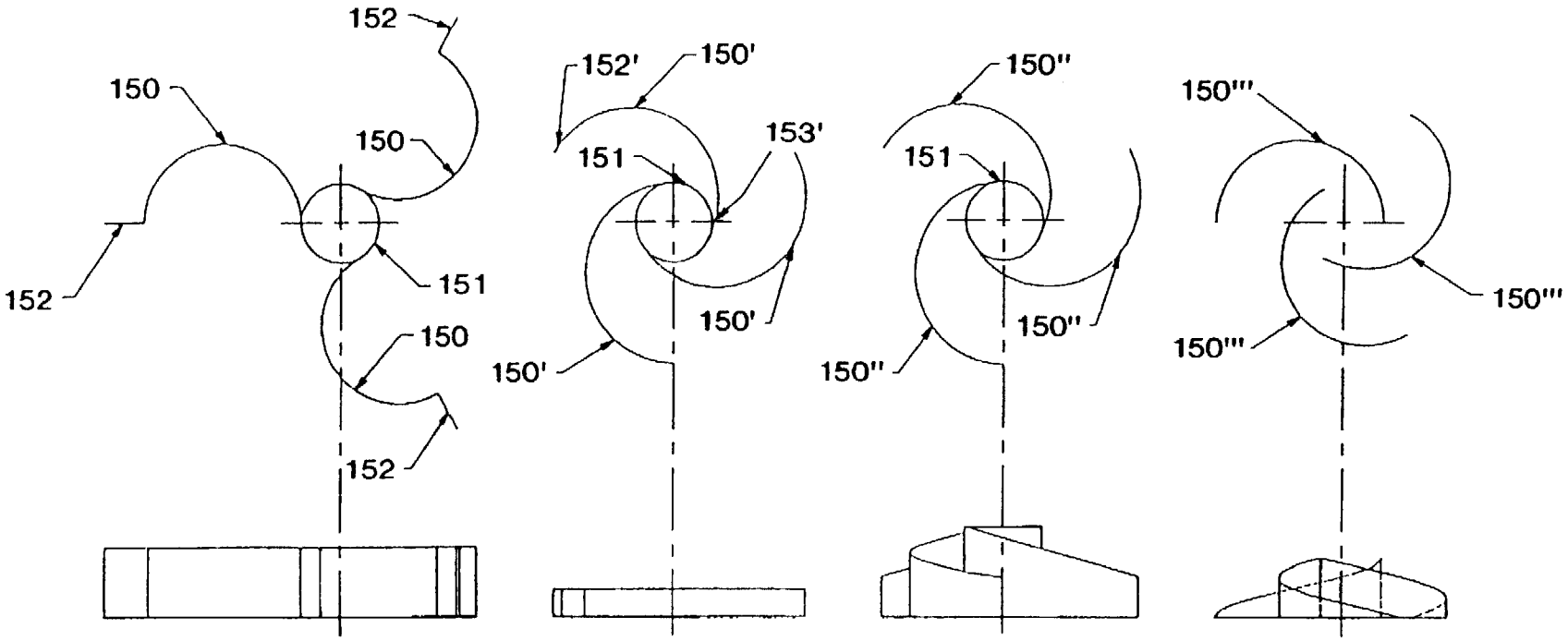
FIG. 2A is a front view of an internal swirl generator in accordance with one embodiment of the present invention.
FIG. 2B is a front view of an internal swirl generator in accordance with one embodiment of the present invention.
FIG. 2C is a front view of an internal swirl generator in accordance with one embodiment of the present invention.
FIG. 2D is a front view of an internal swirl generator in accordance with one embodiment of the present invention.

In FIG. 2A, three vanes 150 are shown, each extending outwardly from a cylindrical section of pipe 151. The vanes 150 are shaped in a semi-circle and feature at the one end farthest from the cylindrical pipe section 151 an end flange 152. The vanes 150 are positioned at about 120° angle to each other, and each have the same height.

FIG. 2B illustrates an alternative embodiment, wherein the vanes 150' spiral from the central cylindrical pipe section 151. The vanes are attached to the pipe section 151 such that an imaginary connecting line from the outer end 152' to the inner end 153' intersects the center of the swirl generator 20. The vanes form a semi-circular arc, and are of the same height. The swirl generator of this embodiment is only half the length of the swirl generator of FIG. 2A.

FIG. 2C illustrates a further embodiment, similar to the embodiment of FIG. 2B, however, the axial lengths of the vanes 150" are modified such a substantially trapezoidal shape is formed when the vanes are rolled out onto a plane.

FIG. 2D illustrates a still further embodiment, again similar to FIG. 2B. However, no central cylindrical pipe is used; the vanes are simply mounted onto the base plate 14, and exhibit a substantially triangular shape when unrolled in a plane.

Process air enters at the base of the burner through the openings 12 in the inlet cylinder 11 and follows the flow guides 13 to create a vortex. Some of the process air in this vortex contacts the internal swirl blades 15, which creates a stronger radial type swirl in the center of the vortex.

The arrangement of the openings 12, flow guides 13, swirl generator 15 and central opening 16 for the fuel lance 63 permits a mixture of some of the process gas with fuel as well as the creation of a swirl which has both tangential and axial components. This design results in a stable mixing zone within a broad standard range of process adjustment. Fuel is added to the burner at the center 16 of the swirling flow, via the lance 63. Preferred fuels are those with no chemically bound nitrogen, such as natural gas, butane, propane, etc., with natural gas being especially preferred in view of its lower calometric flame temperature. The intensity and location of the central process air swirl determines the required fuel velocity and nozzle location. The fuel should be added to the swirl mixing chamber at a constant velocity in order to reduce the $NO_x$ emissions of the burner. Low gas flow velocities result in a poor mixture of fuel and process gas, and, consequently, high $NO_x$ levels. High gas velocities also lead to poor mixing and high $NO_x$ levels. Preferably, the gas flow velocities are in a range between 50 and 150 m/s. The amount of fuel entering the burner is determined by a valve assembly and conventional actuator and temperature control device. Fuel is increased or decreased as required to maintain the control temperature set point.

Fuel and process air begin to mix as they proceed axially down the mixing chamber 10 and enter the combustion section 50 of the burner. In view of the flow characteristics inside the combustion chamber 50, the mixture of fuel and process gas remains intact until it is completely burned in the combustion chamber 50, so that merely combustion products are emitted from the burner 1.

Figure 3A:
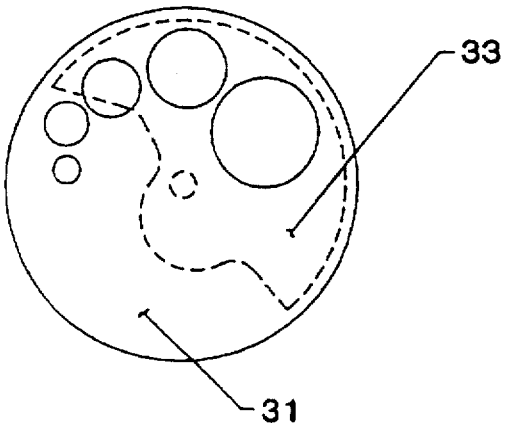
FIG. 3A is a front view of a round nozzle/valve assembly in accordance with one embodiment of the present invention.
Figure 3B:
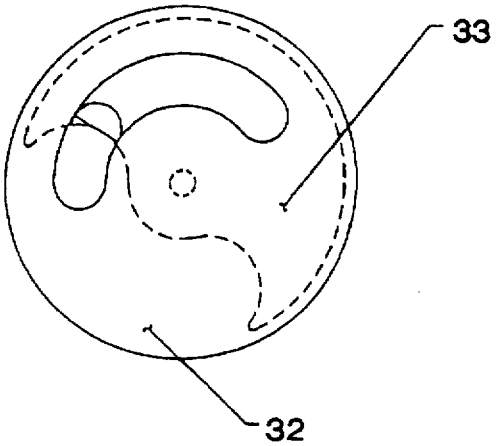
FIG. 3B is a front view of a round nozzle/valve assembly in accordance with another embodiment of the present invention.
Figure 4A:
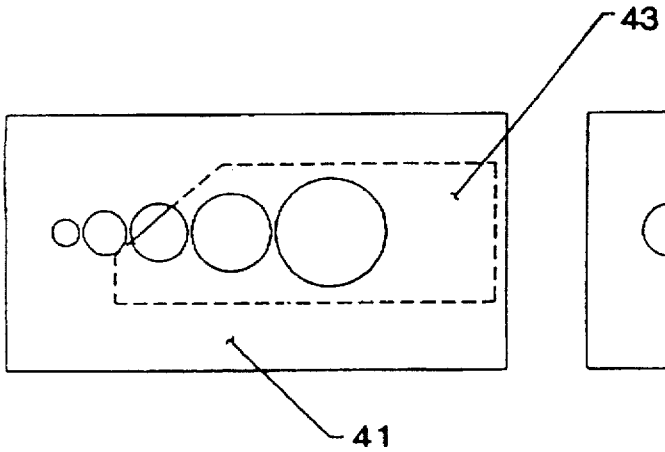
FIG. 4A is a front view of a rectangular nozzle/valve assembly in accordance with one embodiment of the present invention.
Figure 4B:
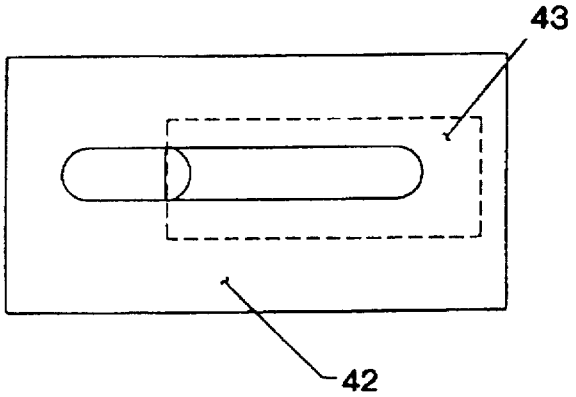
FIG. 4B is a front view of a rectangular nozzle/valve assembly in accordance with another embodiment of the present invention.
Figure 8:
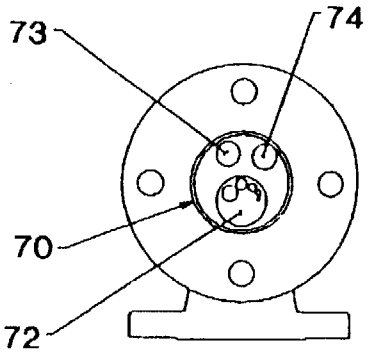
FIG. 8 is a front view of the lance of FIG. 7.
Figure 7:
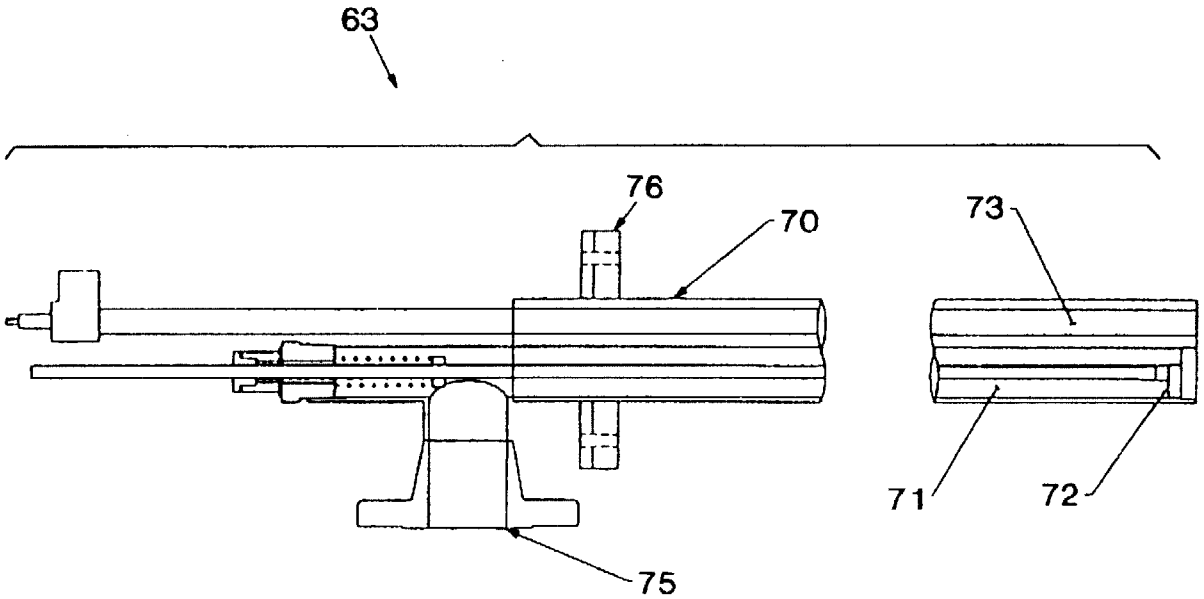
FIG. 7 is a side view of a lance in accordance with one embodiment of the present invention.

Turning to FIGS. 7 and 8, a preferred embodiment of lance 63 is illustrated. The lance 63 includes an outer pipe 70 in which a pipe 71 supplying fuel such as natural gas, an exhaust nozzle arrangement 72, a flame detector 73 and a pilot light At one end outside of the outer pipe 70, the fuel supply pipe 71 has a flange-shape inlet 75 through which fuel is fed into the pipe 71. To attach the lance 63, such as to the holding assembly 60 of the burner 1, the outer pipe 70 features a disk-shaped flange 76. Flame detector 73, preferably a UV sensor, allows observation of the pilot as well as the operating flame. The control of fuel velocity into the burner assembly is important to the NOx performance and turndown (the ratio of high fire to low fire, with low fire being 1) of the burner, and is accomplished with an adjustable nozzle assembly. Turndown ratios as high as 60:1 may be achieved with the burner of the present invention. Low fuel velocity will result in poor air/fuel mixing and/or flame out. High fuel velocity will push the fuel past the mixing point, resulting in higher NOx emissions and flame blow off. FIGS. 3A and 3B illustrate round embodiments of the gas nozzle designed to control the fuel velocity, and FIGS. 4A and 4B illustrate rectangular embodiments. A series of nozzle openings in sequence provides a close approximation to constant velocity in the designs of FIGS. 3A and 4A. These nozzles may be all of the same size or of a progressing ratio. They may be located in a linear or semi-circular pattern, with the latter being preferred in view of the burner configuration and swirl pattern of the process air. Alternatively, slots can be used in place of the series of nozzle openings, as shown in FIGS. 3B and 4B. A sliding valve 33, 33' and 43, 43' is a matching machined piece which as it moves sequentially, opens the fuel nozzles or increases the slot opening. Progressive opening of the valve yields a constant fuel velocity. This progressive nature of the valve provides the constant velocity feature of the burner. For the semicircular design, a rotating cam-shaped piece 33 or 33' is used (FIGS. 3A, 3B). For the linear design, this is accomplished by sliding the valve 43, 43' across the back face of the nozzles/slot (FIGS. 4A, 4B). Complete closure of the valve is possible. Movement of the valve is controlled by conventional controller/actuator technology well known to those skilled in the art.

Location of the nozzle/valve assembly is critical to the response of the burner. The combination valve/nozzle assembly is located at the end of the fuel lance 63 in the mixing chamber 10 of the burner 1, which ensures immediate response to control signals, and virtually eliminates burner hunting.

Figure 5B:
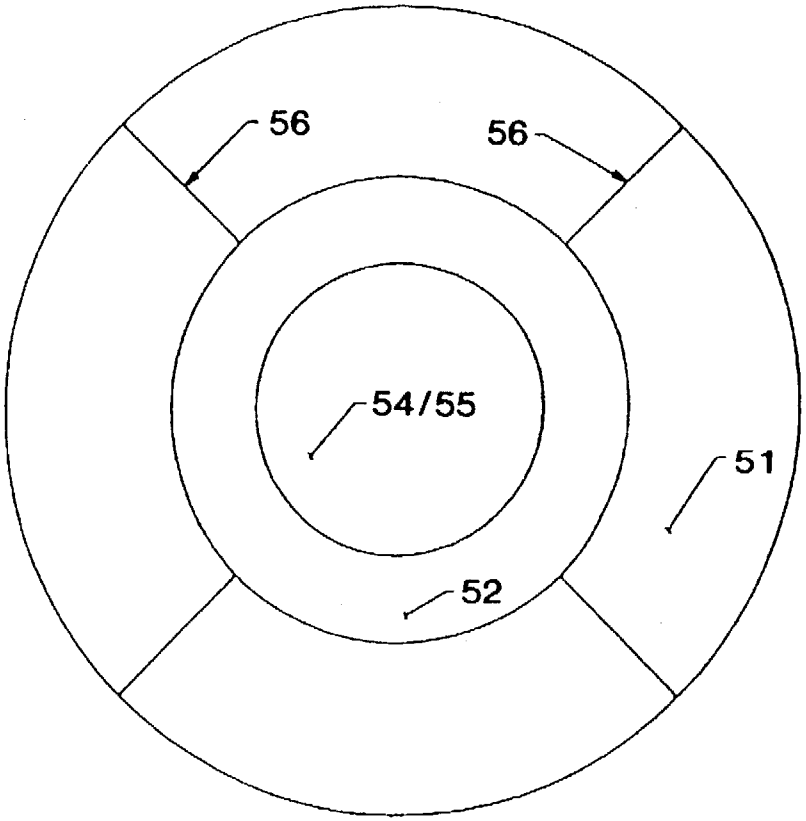
FIG. 5B is a front view of the combustion chamber in accordance with the present invention.
Figure 5A:
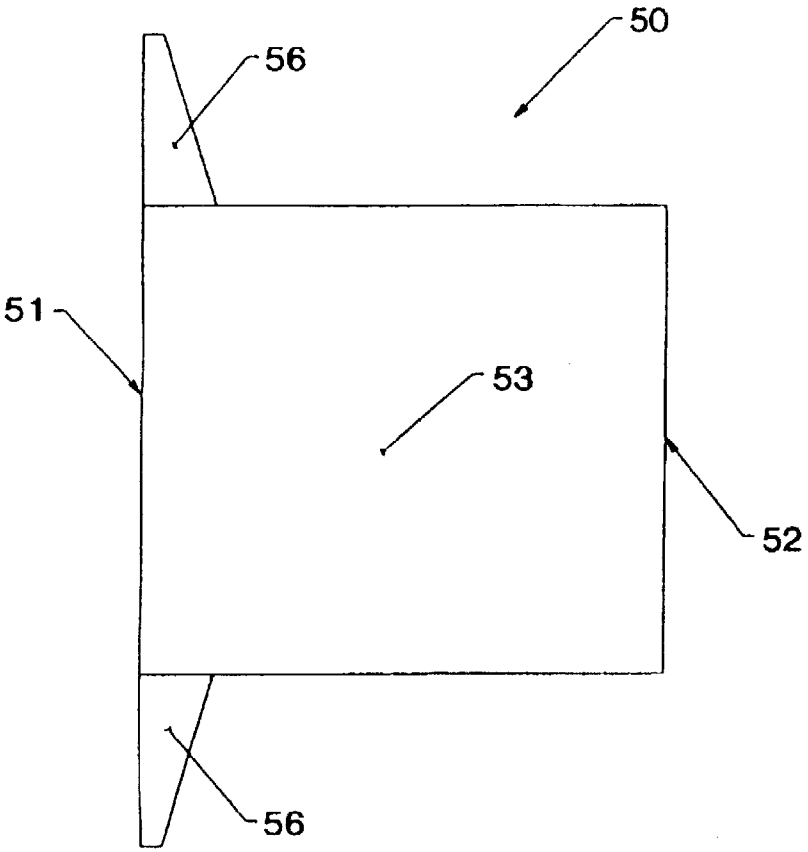
FIG. 5A is a side view of the combustion chamber in accordance with the present invention.

As can be seen from FIG. 6, the burner combustion chamber 50 is located at the exit of the swirl mixing chamber 10, and provides an enclosed space for the combustion of the fuel. Combustion of the fuel in an enclosed chamber allows for control of the reaction. Limiting the amount of oxygen and nitrogen in the combustion chamber of the burner lowers NOx emissions. In addition, complete combustion inside the chamber eliminates flame contact with the process air, thereby also minimizing NOx formation. The chamber also acts as a heat exchange medium allowing some heat transfer to the process. Turning now to FIGS. 5A and 5B, combustion chamber 50 includes two orifice plates 51, 52 and a cylinder 53. The exit orifice plate 52 is in the shape of a flat ring whose outer diameter corresponds to the diameter of the cylinder 53. Through the exit orifice plate 52 is an opening 54 smaller than the diameter of the cylinder 53 and through which the combustion gases can escape from the combustion chamber 50. By providing restricted opening 54 at the end of the combustion chamber 50, additional flame stability is achieved. The inlet orifice plate 51 is also in the shape of a flat ring and features a centrally located opening 55 whose diameter corresponds to the diameter of the opening 54 in the exit orifice plate 52. Preferably the diameter of openings 54 and 55 correspond to the diameter of cylinder 11 of swirl mixing chamber 10. The outer diameter of the inlet orifice plate 51 is greater than the diameter of the cylindrical casing of the swirl mixing chamber. The inlet orifice plate 51 and the exit orifice plate 52 provide a large shear stress on the swirling incoming and outgoing flows. These shear stresses provide the dynamic equilibrium which contains the flame inside the chamber. The swirling flow inside the chamber 50 and the recirculation zones created by the orifices ensure complete combustion of the fuel, and only products of combustion exit the chamber 50. An abrupt change in diameter is formed between the swirl chamber and the burner combustion chamber 50, which causes the hot combustion gases to recirculate, which results in flame stability. Preferably, the diameter of the burner combustion chamber 50 is about twice as large as the ring opening between the swirl chamber and the combustion chamber. Wedge-shaped reinforcing straps 56 strengthen the construction of the cylinder 50 and improve the heat exchange between the combustion chamber and the process gas flowing around it. Exterior cooling ribs (not shown) also can be located on the combustion chamber 50 exterior to further enhance heat transfer.

Pressure drop across the burner assembly controls the amount of process air entering the burner and determines the intensity of the swirling flow inside the burner. The preferred method for pressure control is to move the mixing and combustion chambers of the burner linearly. Due to the location of the burner in the post-combustion device (FIG. 6), movement in and out of the housing 60 changes the orifice size at the inlet to the flame tube 109, which creates the pressure drop necessary for proper burner operation. Movement of the burner may be controlled to maintain a fixed pressure drop in the burner, or may be programmed to provide a specific burner position corresponding to process air and fuel rates.

Figure 9:
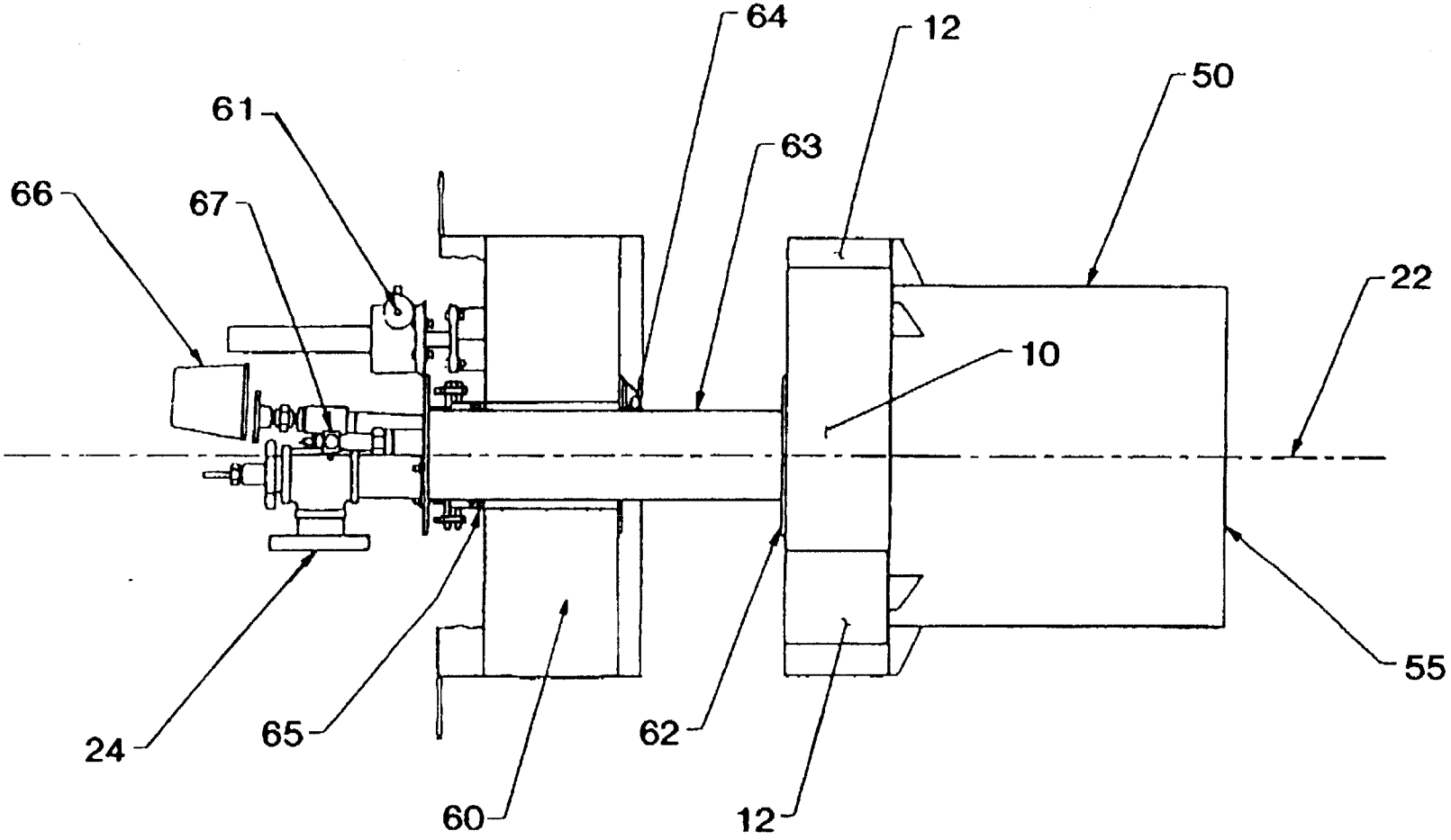
FIG. 9 is a schematic view of the burner assembly in accordance with the present invention.

The movement of the burner is preferably accomplished via linear motion. FIG. 9 shows a preferred assembly. The combustion chamber 50 and swirl mixing chamber 10 are attached to lance assembly 63 by a mounting flange 62. This assembly passes through the center of the insulated mounting housing 60 on the longitudinal axis of 22 of the burner. Hot side bearing assembly 64 and cold side bearing assembly 65 support the moving sections (i.e., the lance 63, the mixing chamber 10 and the combustion chamber 50) of the burner. In and out linear motion of the burner relative to the housing 60 is controlled by the positioning linear actuator 61 coupled to lance 63. A UV flame detector 66 and spark ignitor 67 are also shown.

Linear position of the burner is controlled by monitoring fuel usage and chamber differential pressure. The differential pressure before and after the burner is measured by sensing pressure in the post combustion device 100 (FIG. 6) both before the burner in feed duct 108, and after the burner in the flame tube 109. The burner is then moved linearly depending upon the measured differential. Since the diameter of the combustion chamber 50 is slightly less, preferably 5–20 mm less, most preferably 10 mm less, than the diameter of the choke point 115 of the flame tube 109, moving the burner in and out changes the size of the orifice between the combustion chamber 50 and the flame tube 109. This controls the pressure drop of the process air flowing past the burner, and therefore controls the amount of process air entering the burner. For example, as the burner is moved forward in the direction toward the end of the flame tube 109, the orifice between the combustion chamber 50 and the flame tube 109 decreases, and the pressure drop of the process air increases. Optimum burner locations for different air flows and firing rates will vary with the application of the burner. Once the correct burner position is determined, computer programming can be used to provide appropriate signals to the positioning actuator to control burner motion.

Although linear actuation of the burner is preferred, it should be understood that other means can be used to change the size of the orifice between the combustion chamber 50 and the flame tube 109 to thereby control the process air flow without departing from the spirit and scope of the present invention.

What is claimed is:

1. A process for burning combustible substances in a process gas, comprising:

providing a post-combustion device having:

an oxidation chamber; a flame robe having an inlet and an outlet, said outlet being in communication with said oxidation chamber; a process gas feed inlet in communication with said flame tube inlet; a burner having a mixing chamber having burner fuel inlet means and process gas inlet means, a burner combustion chamber having a first end in communication with said mixing chamber and a second end in communication with said flame tube;

supplying burner fuel to said burner fuel inlet means;

causing a first portion of said process gas to enter into said process gas inlet means, mix with said burner fuel in said mixing chamber, and flow out of said mixing chamber and into said burner combustion chamber;

combusting said burner fuel that is mixed with said first portion of said process gas in said burner combustion chamber;

causing the burned fuel and first portion of process gas to flow out of said burner combustion chamber and into said flame tube;

causing a second portion of said process gas to enter said flame tube and mix with said burned fuel and first portion of process gas;

sensing the pressure in said process gas feed inlet;

sensing the pressure in said flame tube;

comparing the sensed pressure in said process gas feed inlet to the sensed pressure in said flame tube; and controlling the amount of said first portion of said process gas entering said burner process gas inlet means based upon said pressure comparison.

2. The process of claim 1 wherein the amount of process gas entering said burner process gas inlet means is controlled by controlling the pressure differential between said process gas feed inlet and said flame tube.

3. The process of claim 2, wherein said pressure differential is controlled by moving said burner combustion chamber linearly with respect to said flame tube.

4. The process of claim 1 wherein the burner fuel is gaseous.

* * * * *